US008106588B2

(12) United States Patent
Braun et al.

(10) Patent No.: US 8,106,588 B2
(45) Date of Patent: Jan. 31, 2012

(54) DIELECTRIC BARRIER DISCHARGE LAMP

(75) Inventors: Norbert Braun, Aachen (DE); Georg Greuel, Roetgen (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 12/744,083

(22) PCT Filed: Jul. 9, 2008

(86) PCT No.: PCT/IB2008/052762

§ 371 (c)(1), (2), (4) Date: May 21, 2010

(87) PCT Pub. No.: WO2009/069015

PCT Pub. Date: Jun. 4, 2009

(65) Prior Publication Data

US 2010/0244688 A1 Sep. 30, 2010

(30) Foreign Application Priority Data

Nov. 28, 2007 (EP) ..... 07121704

(51) Int. Cl.
*H05J 65/04* (2006.01)

(52) U.S. Cl. ..... 313/631; 313/607; 313/634; 313/234

(58) Field of Classification Search ..... None
See application file for complete search history.

(56) References Cited

U.S. PATENT DOCUMENTS

| | | | | |
|---|---|---|---|---|
| 5,173,638 | A * | 12/1992 | Eliasson et al. | 313/634 |
| 5,666,026 | A | 9/1997 | Matsuno et al. | |
| 6,294,869 | B1 * | 9/2001 | Adachi et al. | 313/607 |
| 7,193,363 | B2 * | 3/2007 | Kawashima | 313/509 |
| 2001/0033137 | A1 * | 10/2001 | Okugi | 313/607 |
| 2004/0263043 | A1 * | 12/2004 | Claus et al. | 313/234 |
| 2005/0017623 | A1 | 1/2005 | Yamamoto et al. | |
| 2008/0265775 | A1 * | 10/2008 | Schiene et al. | 313/607 |
| 2010/0109505 | A1 * | 5/2010 | Rosier et al. | 313/244 |

FOREIGN PATENT DOCUMENTS

| | | | |
|---|---|---|---|
| DE | 19741688 | A1 | 4/1999 |
| DE | 10004133 | A1 | 10/2000 |
| DE | 102005006656 | A1 | 8/2006 |
| EP | 0703603 | A1 | 3/1996 |
| JP | 2004311107 | A | 11/2004 |
| WO | 2006056921 | A2 | 6/2006 |

* cited by examiner

*Primary Examiner* — Ashok Patel

(57) ABSTRACT

It is provided a dielectric barrier discharge lamp (10) for providing ultraviolet light, comprising an outer tube (12) filled with a discharge gas for providing ultraviolet light, an inner tube (14) arranged at least partially inside the outer tube (12), an outer electrode (16) electrically connected to the outer tube (12) and an inner electrode (18) electrically connected to the inner tube (14), wherein the inner electrode (18) comprises a conductor (20) and a plurality of an conductive granulated material (22) for providing an electrical contact between the conductor (20) and the inner tube (14). Due to the conductive granulated material (22) an electrical contact between the conductor (20) and the inner tube (14) is safeguarded and different thermal expansions of the inner electrode (18) and the inner tube (14) are compensated at the same time without applying mechanical stress to the inner tube (14). This leads to a dielectric barrier discharge lamp (10), which comprises an increased life time without the need for external cooling.

16 Claims, 2 Drawing Sheets

DIELECTRIC BARRIER DISCHARGE LAMP

FIELD OF THE INVENTION

The invention relates to the field of dielectric barrier discharge lamps, by which ultraviolet light may be generated for photochemical, photophysical or photobiological reactions like a treatment of liquid or gaseous media.

BACKGROUND OF THE INVENTION

Dielectric barrier discharge lamps become hot during operation, so that the dielectric barrier discharge lamp may break due to different thermal expansion of its parts. Thus, it is necessary in many cases to cool the dielectric barrier discharge lamp by means of a coolant like water.

From U.S. Pat. No. 5,666,026 a dielectric barrier discharge lamp is known, which comprises an inner tube arranged inside an outer tube, wherein between the inner tube and the outer tube a discharge gas for providing ultraviolet light is sealed. An outer electrode is provided on the outside of the outer tube and an inner electrode is provided on the inside of the inner electrode, so that the tubes provide a dielectric barrier and a discharge arc between the electrodes may occur for stimulating the discharge gas to emit ultraviolet light. The inner electrode is provided as mainly tubular bush comprising a slit, so that the tubular inner electrode contacts the inner tube in a spring-loaded manner for electrical contact. Due to the spring-loaded inner electrode different thermal expansions of the inner tube and the inner electrode are compensated, so that an external cooling may be rendered unnecessary.

It is a disadvantage of such kind of a dielectric barrier discharge lamp that the inner tube is applied by a comparable high mechanical stress due to the spring-loaded inner electrode leading to a low life time. Further the positioning of the inner electrode inside the inner tube is difficult and have to be performed by means of a special tool. This leads to a big size of the inner tube as well as the lamp and renders the production expensive.

SUMMARY OF THE INVENTION

It is an object of the invention to provide a dielectric barrier discharge lamp, which comprises an increased life time without the need for external cooling.

This object is achieved by a dielectric barrier discharge lamp for providing ultraviolet light, comprising an outer tube filled with a discharge gas for providing ultraviolet light, an inner tube arranged at least partially inside the outer tube, an outer electrode electrically connected to the outer tube and an inner electrode electrically connected to the inner tube, wherein the inner electrode comprises a conductor and a plurality of a conductive granulated material for providing an electrical contact between the conductor and the inner tube.

Due to the conductive granulated material an electrical contact between the conductor and the inner tube is safeguarded and different thermal expansions of the inner electrode and the inner tube are compensated at the same time without applying mechanical stress to the inner tube. This leads to a dielectric barrier discharge lamp, which comprises an increased life time without the need for external cooling. Between the different particles of the granulated material is enough space provided for a thermal expansion of the particles. Further a fixed connection between the conductor and/or the granulated material to the inner tube is prevented, so that the different thermal expansion of the inner tube on the one side and the conductor and the granulated material an the other side would not lead to a mechanical stress. This renders an operation mode possible, by which an external cooling is prevented. Particularly the manufacturing is facilitated and more cost-efficient, since for positioning the inner electrode it is only necessary to provide the conductor and to fill the remaining volume inside the inner tube preferably partly with the granulated material. Complicated designed tools for manufacturing the lamp are not necessary. Particularly the inner electrode may be manufactured without the need to provide a tool inside the inner tube, so that the dielectric barrier discharge lamp according to the invention may be miniaturized without reducing the amount of emitted light.

Particularly the inner electrode fills a volume inside the inner tube by a volume-portion p of $5\% \leqq p \leqq 95\%$, particularly $30\% \leqq p \leqq 90\%$, preferably $60\% \leqq p \leqq 85\%$. This portion is sufficient to safeguard a high chance that the granulated material provides an electric contact between the conductor and the inner tube. At the same time it is left enough space that the inner electrode may expand due to thermal expansion without affecting the inner tube. Preferably the conductor may be arranged spaced to the inner tube, so that the electrical contact between the conductor and the inner tube is provided by the granulated material only, wherein an electrical contact may occur at any radial direction from the conductor to the inner tube. The outer electrode may be provided as meshed web surrounding the outer tube, so that the light passes the outer electrode through the meshes.

Further it is possible that the inner tube may be filled mainly by the granulated material only and the conductor just provides electrical contact between the granulated material and an electrical source. In this case the electrical conduction over mainly the whole length of the inner tube in axial direction is provided by the granulated material, wherein the amount of the granulated material is preferably above the percolation threshold with respect to the volume inside the inner tube and/or with respect to the electrical conduction in axial direction along the inside of the inner tube. This leads to a facilitated manufacturing. In another embodiment of the invention the amount of the granulated material is below the percolation threshold with respect to the volume inside the inner tube and/or with respect to the electrical conduction in axial direction along the inside of the inner tube. In this case the conductor extends over mainly the whole length of the inner tube in axial direction and the granulated material provides electrical contact between the conductor and the inner tube at several sporadic places. Only less material is necessary to provide a good operability.

In a preferred embodiment the inner tube comprises an axial proximal end and an axial distal end, wherein only the proximal end is fixed to the outer tube for sealing the discharge gas outside the inner tube and inside the outer tube. Since the inner tube is only fixed at one side the opposite side may expand due to thermal expansion without affecting other parts of the lamp. A mechanical stress between the inner tube and the outer tube is prevented. Since the inner tube is fixed only on one end to the outer tube and the inner electrode is free to move, a large temperature difference between the inner tube and the outer tube is allowed without the risk of a lamp failure due to excess mechanical forces, which may lead to a cracking of the lamp.

Particularly the outer tube comprises at least one, particularly at least three grooves for supporting the inner tube. A mechanical stress due to gravity forces or due to acceleration forces to the inner tube may be at least reduced. Since a relative movement of the inner tube with respect to the groove is still possible and the groove provides only a low friction the stability of the inner tube is not affected. Particularly several grooves provide a three point bearing with a clearance fit, so that a definite gap between the inner tube and the outer tube may be kept constant over the whole length in axial direction of the inner tube. Preferably the at least one groove is obtainable by heating a part of the outer tube and forming the heated part inwards by a negative pressure inside the outer tube. The manufacturing of the grooves is very fast and easy this way.

In a preferred embodiment the outer tube comprises a distal front face comprising a particularly tubular protrusion for supporting an axial distal end of the inner tube, wherein the protrusion is directed inwards and/or outwards. The protrusion may provide a bearing with a clearance fit so that the mechanical stability of the inner tube is improved without applying mechanical stress to the inner tube. The protrusion may particularly be provided by a suction duct by which a negative pressure is provided inside the outer tube. Since the tubes and the suction duct may be made of quartz glass the protrusion may be provided by heating the distal front face of the outer tube and pushing the suction duct through the distal front face.

Preferably the inner tube comprises an axial proximal end closed by a sealing allowing an escape of gaseous components and preventing an escape of the granulated material. Due to the sealing the granulated material stay inside the inner tube but in the case that the inner tube and/or the inner electrode become such hot that components become gaseous an overpressure inside the inner tube is prevented. The sealing may be provided by a porous plug and/or a membrane and/or a bonding which are permeable for gaseous components.

The granulated material may be provided as powder and/or sand and/or suspension, wherein the particles of the granulated material comprise a volume equivalent sphere diameter d of particularly 1.00 mm$\leqq$d$\leqq$0.001 mm, preferably 0.50 mm$\leqq$d$\leqq$0.007 mm, more preferred 0.30 mm$\leqq$d$\leqq$0.01 mm and most preferred 0.20 mm$\leqq$d$\leqq$0.07 mm. Due to this design of the granulated material the granulated material is good free flowing and very movable inside the inner tube. Further a less number of adjacent particles is sufficient to provide electrical contact between the conductor and the inner tube.

In a preferred embodiment the dielectric barrier discharge lamp is miniaturized. Particularly an outer diameter $d_a$ of the outer tube is $d_a$=15 mm±2.0 mm and an outer diameter $d_i$ of the inner tube is 1.0 mm$\leqq d_i \leqq$8.0 mm, particularly 2.0 mm$\leqq d_i \leqq$6.0 mm, preferably 3.0 mm$\leqq d_i \leqq$5.0 mm and most preferred $d_i$=4.0 mm±0.75 mm. Due to this design the lamp fits to lamp housings of the T5-standard, so that a replacement of existing lamps is facilitated and existing periphery parts may be used for the dielectric barrier discharge lamp according to the invention. Further a gap between the inner tube and the outer tube is provided, that prevents a too high ignition voltage and permits a discharge arc long enough for exciting a lot of excimer molecules of the gas.

BRIEF DESCRIPTION OF THE DRAWINGS

These and other aspects of the invention will be apparent from and elucidated with reference to the embodiments described hereinafter.

In the drawings.

DETAILED DESCRIPTION OF EMBODIMENTS

Figure 1:
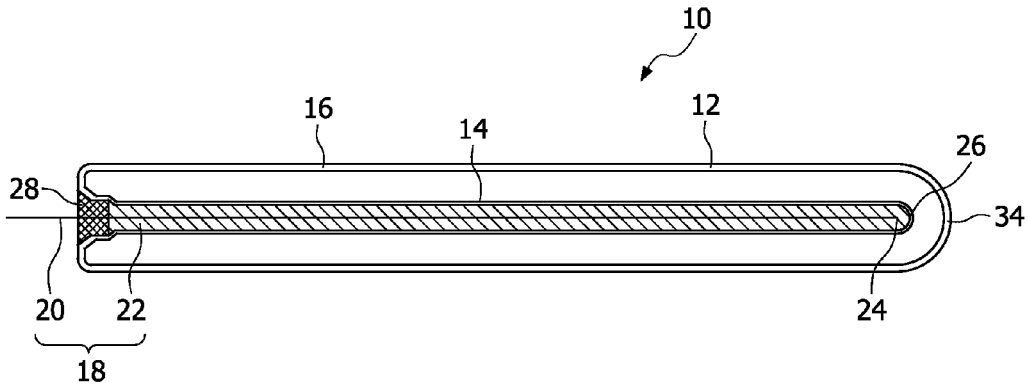
FIG. 1 is a sectional side view of a dielectric barrier discharge lamp in a first embodiment.

In the in FIG. 1 illustrated first embodiment of the dielectric barrier discharge lamp 10 according to the invention the dielectric barrier discharge lamp 10 comprises an outer tube 12 and an inner tube 14 arranged coaxial to the outer tube 12. The dielectric barrier discharge lamp 10 comprises an outer electrode 16, which may be a conductive coating or preferably a conductive meshed web. The outer electrode 16 may be arranged on the outside or the inside of the outer tube 12.

The inner tube 14 comprises an inner electrode 18 consisting of a conductor 20 and a conductive granulated material 22, wherein the inner tube 14 is only partially filled by the conductor 20 and the granulated material 22. For sake of clarity the specific particles of the granulated material and the partial filling of the inner tube 14 are not illustrated in detail. Due to the partial filling of the inner tube 14 by the conductive granulated material 22 an electrical contact between the conductor 20 and the inner tube 14 is safeguarded. Further it is enough space provided for thermal expansion of the conductor 20 and the particles of the granulated material 22 without affecting the inner tube 14.

A distal end 24 of the conductor 20 is arranged spaced to a distal end 26 of the inner tube 14 allowing a thermal expansion of the conductor in axial direction. Since during operation of the dielectric barrier discharge lamp 10 different temperatures will occur at the outer tube 12 and the inner tube 14, the inner tube 14 is only at one end connected to the outer tube 16 allowing a thermal expansion of the inner tube in axial direction relative to the outer tube 12.

Further the inner tube 14 is closed by a porous plug 28, so that gaseous components may escape the inner tube 14 but the particles of the granulated material are sealed into the inner tube 14. Due to the plug 28 the alignment of the conductor 20 may be adjusted. In the illustrated embodiment the conductor 20 is arranged coaxial to the inner tube 14.

Figure 2:
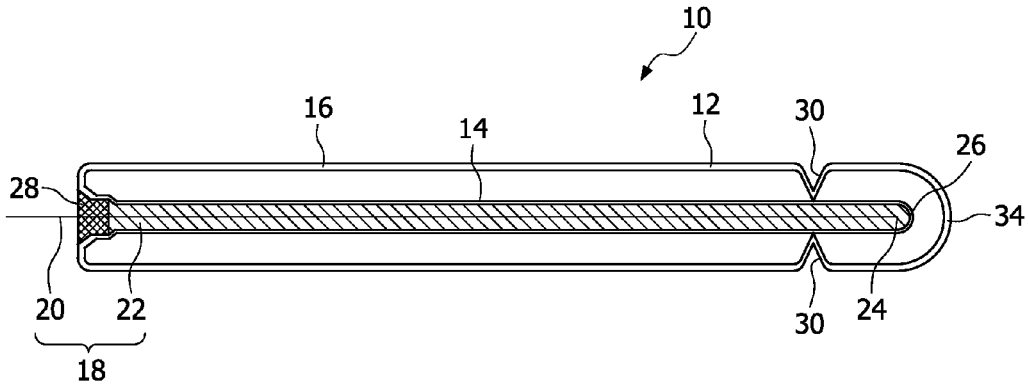
FIG. 2 is a sectional side view of a dielectric barrier discharge lamp in a second embodiment.

In a second embodiment of the dielectric barrier discharge lamp 10 illustrated in FIG. 2 the outer tube 12 comprises grooves 30, by which the inner tube 14 may be at least partially supported. Due to the chosen design of the grooves 30 a vibration or swinging of the inner tube 14 may be prevented leading to an increased mechanical stability of the inner tube 14.

Figure 3:
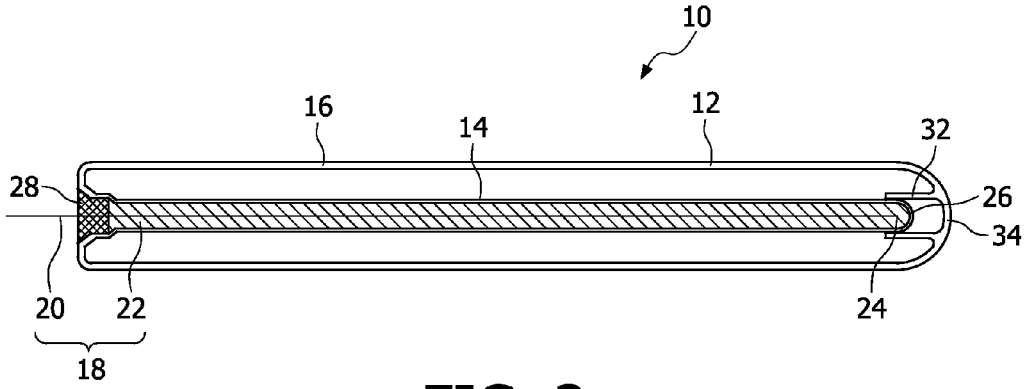
FIG. 3 is a sectional side view of a dielectric barrier discharge lamp in a third embodiment.

In a third embodiment of the dielectric barrier discharge lamp 10 illustrated in FIG. 3 the increased mechanical stability of the inner tube 14 is provided by a mainly tubular protrusion 32 at a distal front face 34 of the outer tube 12. Between the distal end 26 of the inner electrode 14 and the protrusion 32 is at least a clearance fit or a greater gap provided allowing a thermal expansion of the inner tube 14 in radial direction.

Figure 4:
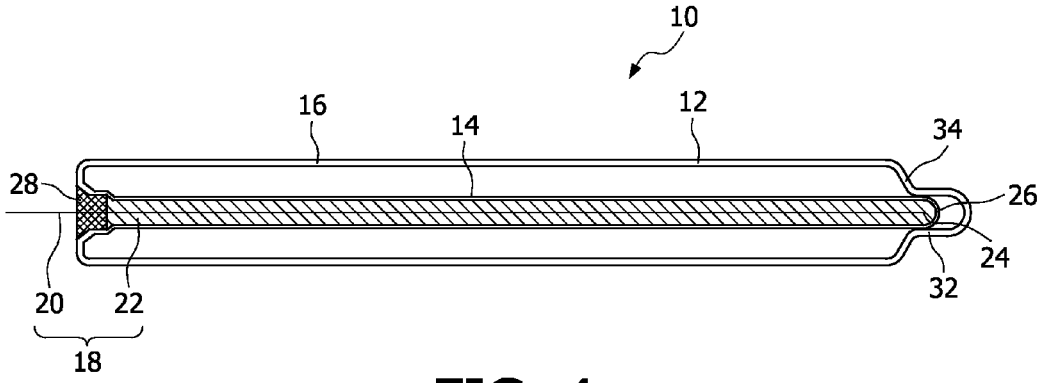
FIG. 4 is a sectional side view of a dielectric barrier discharge lamp in a fourth embodiment and FIG. 5 is a sectional side view of a dielectric barrier discharge lamp in a fifth embodiment.
Figure 5:
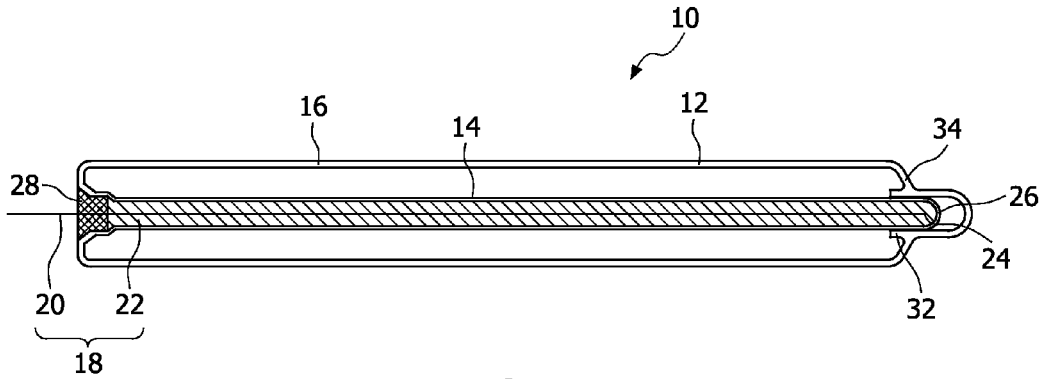

In the embodiment illustrated in FIG. 3 the protrusion 32 is directed inwards. In a fourth embodiment illustrated in FIG. 4 the protrusion 32 may be directed outwards for instance when this protrusion 32 is used prior as a suction duct by which a negative pressure is provided inside the outer tube 12. Further it is possible that the protrusion 32 may extend inwards as well as outwards as illustrated in FIG. 5.

While the invention has been illustrated and described in detail in the drawings and foregoing description, such illustration and description are to be considered illustrative or exemplary and not restrictive; the invention is not limited to the disclosed embodiments. For example, it is possible to operate the invention in an embodiment wherein the protrusion 32 as well as the grooves 30 is provided. Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage. Any reference signs in the claims should not be construed as limiting the scope.

The invention claimed is:

1. Dielectric barrier discharge lamp for providing ultraviolet light, comprising an outer tube filled with a discharge gas for providing ultraviolet light, an inner tube arranged at least partially inside the outer tube, an outer electrode electrically connected to the outer tube and an inner electrode electrically connected to the inner tube, wherein the inner electrode comprises a conductor and a plurality of a conductive granulated material for providing an electrical contact between the conductor and the inner tube.

2. Lamp according to claim 1, wherein the inner electrode fills a volume inside the inner tube by a portion p of $5\% \leqq p \leqq 95\%$.

3. Lamp according to claim 1, wherein the amount of the granulated material is below the percolation threshold with respect to at least one of a volume inside the inner tube and the electrical conduction in axial direction along the inside of the inner tube.

4. Lamp according to claim 1, wherein the inner tube comprises an axial proximal end and an axial distal end (26), wherein only the proximal end is fixed to the outer tube for sealing the discharge gas outside the inner tube and inside the outer tube.

5. Lamp according to claim 1, wherein the outer tube comprises at least one groove for supporting the inner tube.

6. Lamp according to claim 5, wherein the at least one groove is obtainable by heating a part of the outer tube and forming the heated part inwards by a negative pressure inside the outer tube.

7. Lamp according to claim 1, wherein the outer tube comprises a distal front face comprising a tubular protrusion for supporting an axial distal end of the inner tube.

8. Lamp according to claim 1, wherein the inner tube comprises an axial proximal end closed by a sealing allowing an escape of gaseous components and preventing an escape of the granulated material.

9. Lamp according to claim 1, wherein the granulated material comprises a plurality of particles having a volume equivalent sphere diameter d of $0.001\ \text{mm} \leqq d \leqq 1.00\ \text{mm}$.

10. Lamp according to claim 1, wherein an outer diameter da of the outer tube is $da = 15\ \text{mm} \pm 2.0\ \text{mm}$ and an outer diameter di of the inner tube is $1.0\ \text{mm} \leqq di \leqq 8.0\ \text{mm}$.

11. Lamp according to claim 1, wherein the inner electrode fills a volume inside the inner tube by a portion p of $30\% \leqq p \leqq 90\%$.

12. Lamp according to claim 1, wherein the inner electrode fills a volume inside the inner tube by a portion p of $60\% \leqq p \leqq 85\%$.

13. Lamp according to claim 1, wherein the granulated material comprises a plurality of particles having a volume equivalent sphere diameter d of $0.007\ \text{mm} \leqq d \leqq 0.50\ \text{mm}$.

14. Lamp according to claim 1, wherein the granulated material comprises a plurality of particles having a volume equivalent sphere diameter d of $0.007\ \text{mm} \leqq d \leqq 0.20\ \text{mm}$.

15. Lamp according to claim 1, wherein an outer di of the inner tube is $2.0\ \text{mm} \leqq di \leqq 6.0\ \text{mM}$.

16. Lamp according to claim 1, wherein an outer di of the inner tube is $di = 4.0\ \text{mm} \pm 0.75\ \text{mM}$.

* * * * *